US009498048B2

(12) United States Patent
Lhoyer

(10) Patent No.: US 9,498,048 B2
(45) Date of Patent: Nov. 22, 2016

(54) RECEPTACLE, MORE PARTICULARLY A BOTTLE FOR A COSMETIC PRODUCT, AN ASSOCIATED MANUFACTURING METHOD AND AN APPLICATOR ASSEMBLY COMPRISING SUCH A RECEPTACLE

(71) Applicant: Albea Services, Gennevilliers (FR)

(72) Inventor: Patrick Lhoyer, Mouy (FR)

(73) Assignee: Albea Services, Gennevilliers (FR)

( * ) Notice: Subject to any disclaimer, the term of this patent is extended or adjusted under 35 U.S.C. 154(b) by 50 days.

(21) Appl. No.: 14/494,702

(22) Filed: Sep. 24, 2014

(65) Prior Publication Data

US 2015/0086257 A1 Mar. 26, 2015

(30) Foreign Application Priority Data

Sep. 26, 2013 (FR) ..... 13 59305

(51) Int. Cl.
*A45D 40/26* (2006.01)

(52) U.S. Cl.
CPC ..... *A45D 40/267* (2013.01); *A45D 40/265* (2013.01); *Y10T 29/49* (2015.01); *Y10T 29/49826* (2015.01)

(58) Field of Classification Search
CPC ..... A45D 40/262; A45D 40/265; A45D 40/267; A46B 2200/1046; A46B 2200/1053; A46B 2200/106; B65D 51/32; B65D 77/0486
See application file for complete search history.

(56) References Cited

U.S. PATENT DOCUMENTS

| | | | | |
|---|---|---|---|---|
| 5,636,931 | A * | 6/1997 | Gueret | A45D 40/265 401/126 |
| 6,474,890 | B1 * | 11/2002 | Gueret | A45D 40/267 401/122 |
| 8,113,350 | B2 | 2/2012 | Sanchez | |
| 2014/0205358 | A1 * | 7/2014 | Pschirer | A45D 40/262 401/126 |

OTHER PUBLICATIONS

French Patent Application 1359305, International Search Report, mailed Jun. 16, 2014.

* cited by examiner

*Primary Examiner* — Mark A Laurenzi
*Assistant Examiner* — Bradley Oliver
(74) *Attorney, Agent, or Firm* — Banner & Witcoff, Ltd.

(57) ABSTRACT

The invention relates to a receptacle, more particularly a bottle for a cosmetic product, to an associated manufacturing method and to an applicator assembly comprising such a receptacle. The invention relates in particular to a receptacle, more particularly a bottle, for a cosmetic product, said receptacle comprising a body forming a container and an intermediate part forming a reservoir, which is capable of containing the cosmetic product and of sliding within said container so as to move with an applicator of said product, under the effect of the viscosity of said product, when said applicator is removed from said reservoir and/or when said applicator is inserted into said reservoir.

17 Claims, 3 Drawing Sheets

Figure 1:
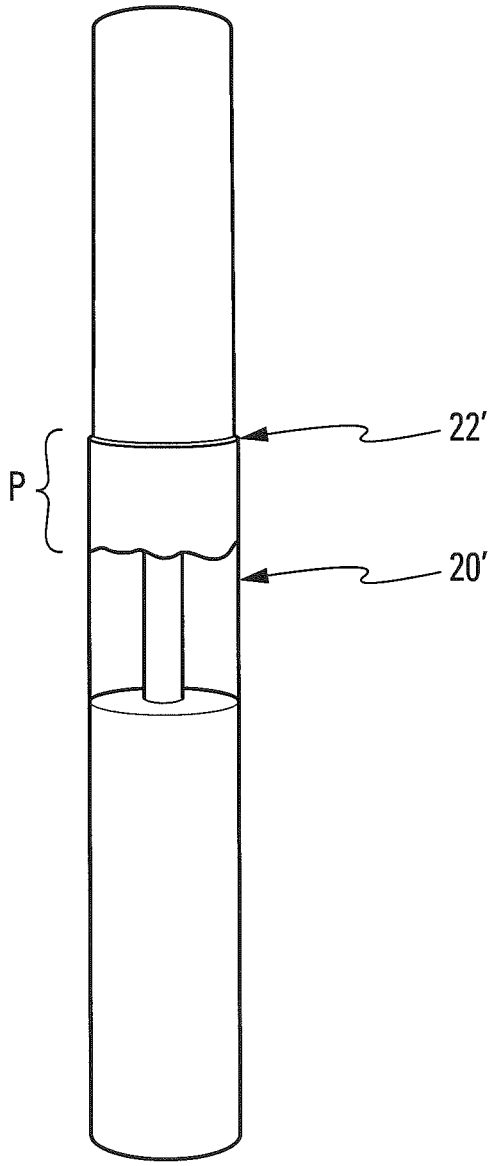

RECEPTACLE, MORE PARTICULARLY A BOTTLE FOR A COSMETIC PRODUCT, AN ASSOCIATED MANUFACTURING METHOD AND AN APPLICATOR ASSEMBLY COMPRISING SUCH A RECEPTACLE

The present application claims priority to, and the benefit of, French Patent Application 1359305, filed on Sept. 26, 2013, which is incorporated by reference herein in its entirety.

The invention relates to a receptacle, more particularly a bottle for a cosmetic product, to an associated manufacturing method and to an applicator assembly comprising such a receptacle.

Applicator assemblies for cosmetic products, in particular for cosmetic products to be applied to the eyelashes, such as mascara, comprising a receptacle containing the cosmetic product and an applicator sub-assembly capable of being removably attached to the receptacle, are known.

The receptacle generally comprises a body, the body comprising walls which delimit a container which contains the cosmetic product, and a collar defining an opening through which the cosmetic product can be removed, the collar having a neck.

The applicator sub-assembly generally comprises a cap capable of being attached to the neck, a rod extending from the cap and an applicator attached to a free end of the rod. The applicator comprises a core and a plurality of protrusions or bristles extending from the core.

When the cap is attached to the neck, the rod and the applicator extend within the container. The applicator is immersed in the cosmetic product contained in the container.

To use the applicator, the user detaches the cap from the neck and removes the applicator from the receptacle.

In order to prevent the applicator from being overloaded with the cosmetic product, the container generally comprises a wiper attached to the inside of the neck. When the user removes the applicator from the receptacle, the applicator and the rod slide against the inside of the wiper. The wiper scrapes the excess cosmetic product from the rod and the applicator. The wiper can thus regulate the amount of product which is on the applicator and prevents excessive cosmetic product from being applied to the eyelashes.

The known applicator assemblies have the drawback of returning only some of the cosmetic product that they contain. In fact, when the user removes the applicator sub-assembly from the receptacle, some of the cosmetic product that is on the rod and the applicator becomes stuck to the underside of the collar of the receptacle within said receptacle. It has been noted that cosmetic product accumulates at this location, thus becoming inaccessible to the user. It is thus lost.

It has also been noted that some of the product adheres to the base of the receptacle, it no longer being possible for the applicator to reach it. In fact, known applicators are designed so as not to abut against the base of the receptacle in which they are immersed. The cosmetic product therefore accumulates at this location, thus becoming inaccessible and lost to the user.

One object of the invention is to increase the capacity for returning cosmetic product to applicator assemblies.

The invention thus relates to a receptacle, more particularly a bottle, for a cosmetic product, said receptacle comprising a body forming a container and an intermediate part forming a reservoir. Said reservoir is capable of containing the cosmetic product and of sliding within said container so as to move with an applicator of said product, under the effect of the viscosity of said product, when said applicator is removed from said reservoir and/or when said applicator is inserted into said reservoir.

It is understood that the reservoir is a part which is separate and independent from the container.

When it is being removed, the applicator is therefore permanently in said reservoir, which moves with it, and, even if some of the product comes away from said applicator, in particular as a result of a wiper, it remains within said reservoir, in contact with the rest of the product.

The viscosity of the product is thus no longer a drawback that causes product to accumulate around a wiper, but an advantage, since it is by means of said viscosity of the product that the reservoir is simultaneously carried along with the applicator. Until it runs out, said product thereby remains in the reservoir, from which it can gradually be removed by the applicator, without accumulating elsewhere in the container.

The receptacle according to the invention therefore allows almost all of the cosmetic product that it contains to be made accessible to the user and thus increases the capacity for returning cosmetic product to applicator assemblies comprising a receptacle of this type.

According to various embodiments of the invention, which may be taken in combination or in isolation:

- said container has a collar, at a first axial end, and a base, at the opposite axial end,
- said reservoir is capable of abutting said collar and/or said base,
- said collar comprises a neck,
- the receptacle according to the invention comprises a wiper configured to scrape excess cosmetic product from the applicator when said applicator is re moved,
- said wiper is attached to the inside of said container, more particularly to the inside of the neck of said container,
- the wiper has a shape capable of covering the internal walls of the collar,
- said wiper is capable of penetrating said reservoir, in particular when said reservoir is abutting said collar,
- the container has a longitudinal extension direction along which the collar and the base are situated,
- said collar and said base are spaced apart along said longitudinal direction by a length L1 and said reservoir has a height L2 in the said same direction, such that $0.2 \leq L2/L1 \leq 0.9$,
- said reservoir is open on the side of said collar and closed on the side of said base,
- said reservoir has a constant internal section along its longitudinal extension direction, from its closed side to its open side,
- the receptacle according to the invention has play J between the container and the reservoir, such that $0.1 \leq J \leq 0.8$, in millimetres,
- the container is rigid,
- the container is made of plastics material, preferably a thermoplastic polymer,
- the container is opaque,
- the container is transparent,
- the container has chemical barrier properties,
- the reservoir is rigid,
- the reservoir is made of plastics material, in particular a thermoplastic polymer, is made of polytetrafluoroethylene (PTFE), in particular in the region of an external wall, is made of elastomer and/or is made of metal material,
- the reservoir is opaque,
- the reservoir is transparent, the external walls of the reservoir form decorations and/or are decorated.

The invention also relates to a method for manufacturing a receptacle as described above, comprising a step of shaping a preform of the container, said preform being open at at least one of its axial ends.

According to various embodiments of the invention, which may be taken in combination or in isolation:

said preform is obtained by material injection moulding, said preform is obtained by blow moulding a plastics impression, said method comprises a step of shaping the reservoir, carried out simultaneously or prior to the step of shaping said preform, the reservoir is obtained by moulding, said method comprises a step of positioning the reservoir within said preform, said method comprises a step of assembling a collar on a first of said axial ends of said preform and/or assembling a base on the axial end opposite said preform, said assembly step following the step of positioning said reservoir within said preform, said assembly step is a step of bonding, ultrasonic welding or overmoulding.

The invention also relates to a cosmetic product applicator assembly, comprising a receptacle as described above, or obtained by the method as described above, and an applicator sub-assembly capable of being attached to said receptacle so that at least part of said applicator sub-assembly is housed within said reservoir.

According to various embodiments of the invention, which may be taken in combination or in isolation:

the applicator sub-assembly comprises a cap capable of being attached to the neck, a rod extending from the cap and an applicator attached to a free end of the rod, the applicator comprises a core and a plurality of protrusions or bristles extending from the core, the applicator forms a brush, the applicator is configured to abut a base wall of the reservoir, said reservoir is filled with viscous cosmetic product, said product is mascara.

Figure 2:
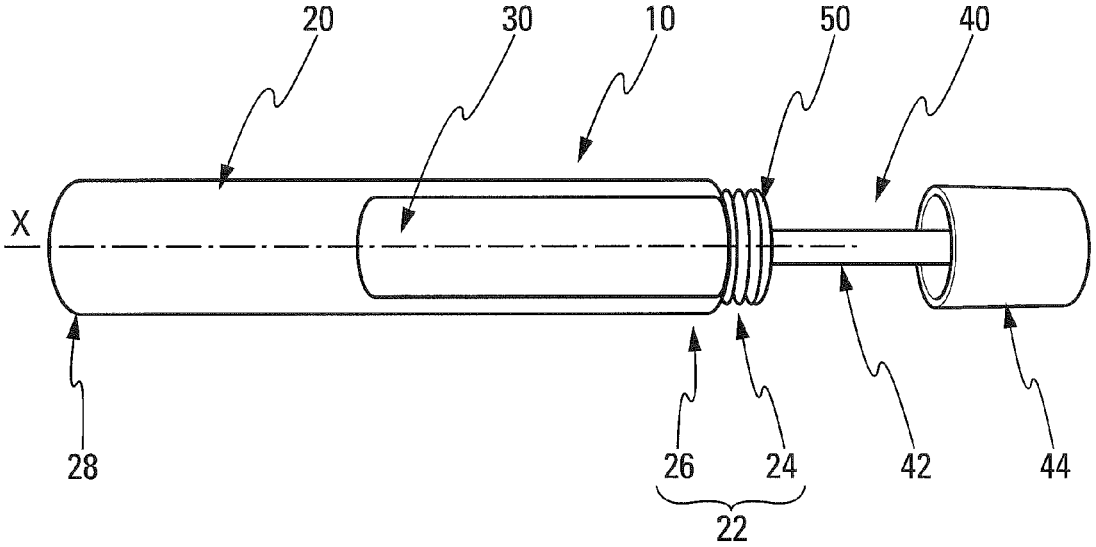
Figure 3:
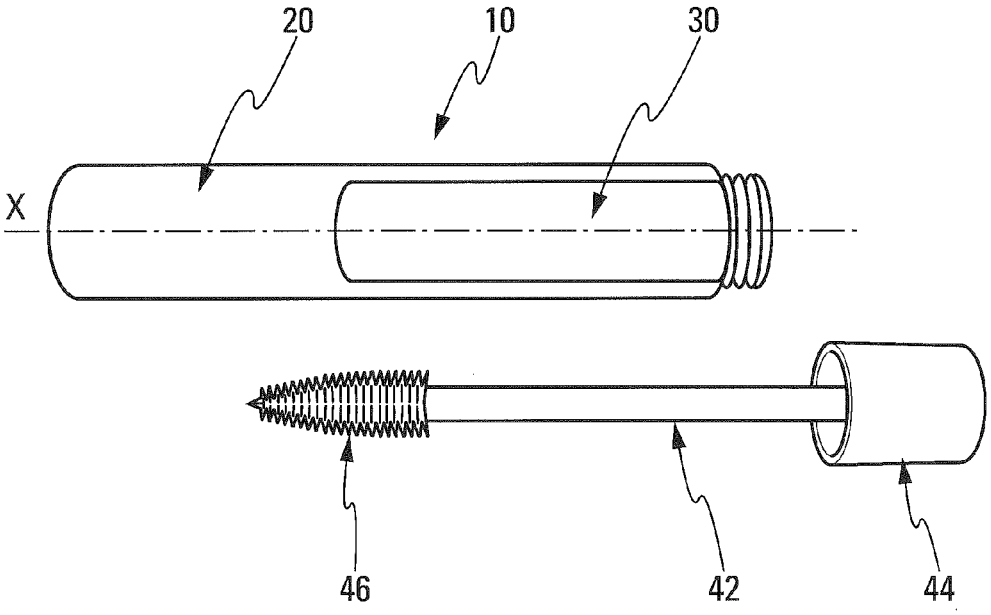
Figure 4:
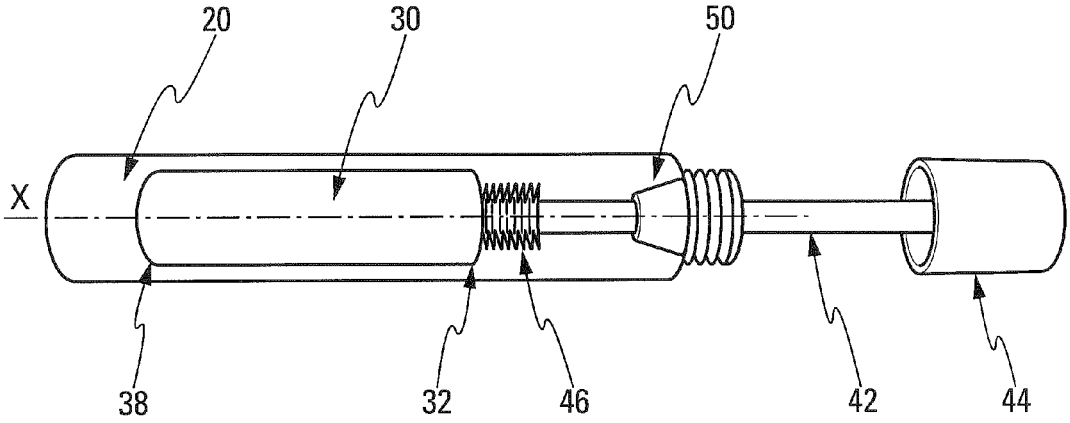
Figure 5:
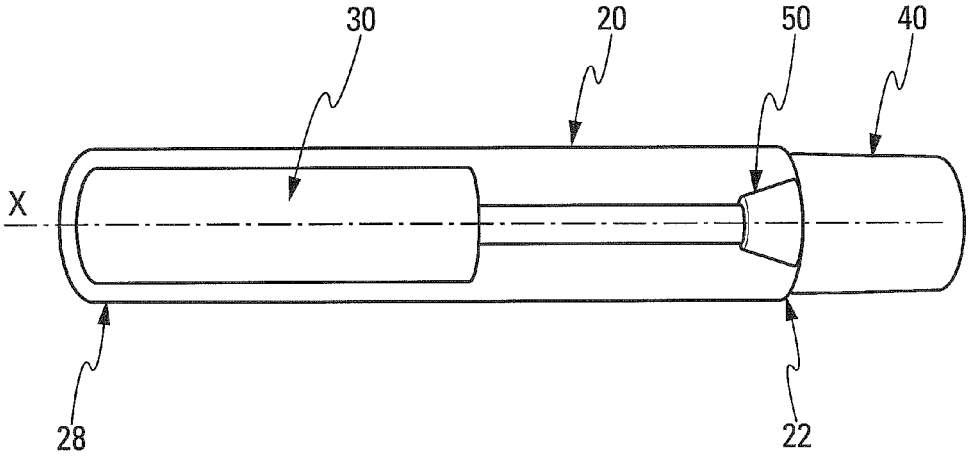

A clearer understanding of the invention and the further objects, details, features and advantages thereof will be facilitated by the following detailed explanatory description of at least one embodiment of the invention, given by way of a purely illustrative and non-limiting example, with reference to the accompanying schematic drawings, in which:

FIG. 1 schematically shows an example of a known applicator assembly which has the above-mentioned drawback of the prior art, FIG. 2 schematically shows an embodiment of an applicator assembly according to the invention, said FIG. 2 showing, in particular, a step of removing an applicator from a receptacle of said applicator assembly, FIG. 3 schematically shows the same applicator assembly as FIG. 2, the applicator sub-assembly being removed from the receptacle, FIG. 4 schematically shows the same applicator assembly as FIG. 2, when the applicator is being inserted into said receptacle, FIG. 5 schematically shows the same applicator assembly as FIG. 2, when the applicator sub-assembly is attached to the receptacle.

As shown in FIGS. 2 to 5, the invention firstly relates to a receptacle 10, more particularly a bottle for a cosmetic product, comprising a body forming a container 20 and an intermediate part forming a reservoir 30.

The container 20 is preferably rigid. In other words, the receptacle 20 is capable of keeping its shape when it is subjected to Earth's gravity, in normal, ambient temperature and pressure conditions, or when it is subjected to manual pressure by the user. It is preferably made of plastics material, preferably a thermoplastic polymer, for example made of polypropylene (PP) and/or of a plastics material belonging to the family of copolyesters, of polyethylene terephthalate (PET) or of polyamide (PA).

For commercial reasons, the container 20 is preferably opaque. However, for other, aesthetic reasons, it may be transparent. The container advantageously has chemical barrier properties, in particular when it is intended to directly or indirectly contain a cosmetic product, the properties of which may be altered if it is not protected from the external environment.

According to the invention, the reservoir 30 is capable of containing all or part of the product contained in said receptacle and of sliding within said container 20 so as to move with an applicator 46 of said product, under the effect of the viscosity of said product, when said applicator 46 is removed from said reservoir 30 and/or when said applicator 46 is inserted into said reservoir 30.

In the same manner as the container 20, the reservoir 30 is preferably rigid. It is preferably made of plastics material, preferably a thermoplastic polymer. It may also be made of polytetrafluoroethylene (PTFE), in particular in the region of an external wall, in order to make it easier for said reservoir to slide in said container. The reservoir 30 may also be made of an elastomer and/or of metal material, for example of aluminium, or of a metal alloy.

For commercial reasons, the reservoir 30 is preferably opaque. However, for other, aesthetic reasons, it may be transparent and/or may be decorated (a variant which is not shown), in particular on the external walls thereof.

FIG. 2 schematically shows an embodiment of an applicator assembly according to the invention. This applicator assembly comprises the receptacle 10 and an applicator sub-assembly 40. The applicator sub-assembly 40 comprises a cap 44 and a rod 42 extending from the cap 44.

FIG. 3 schematically shows the same applicator assembly as FIG. 2, in particular when the applicator sub-assembly 40 is removed from the receptacle 10. In this figure, it may be noted that an applicator 46 is attached to a free end of the rod 42. This applicator 46 preferably comprises a core and a plurality of protrusions or bristles extending from the core. This applicator 46 forms a brush which may be moulded, twisted or a hybrid of the two (moulded and twisted). Since the shape of the brush 46 is not limited to the embodiment shown, it may be straight or curved. In other words, the shape, the production method and the composition of the elements making up said brush 46 are not limited by the present invention. Thus, although the embodiment shown here comprises a brush 46 of a given type, it should be noted that any other type of brush 46 may be used within the scope of the present invention. For example, it is also possible to provide a brush 46 in a plurality of parts, it being possible for said parts to be different brushes, or a brush and a connected distal end piece. The applicator may also be flocked and may be in the form of a soft brush or an applicator intended for applying make-up to the lips (usually called "lip gloss").

As can be seen from the figures, the container 20 has a collar 22 at a first axial end and a base 28 at the opposite axial end. The axis along which the collar 22 and the base 28 are situated is denoted X in FIGS. 2 to 5; this axis X corresponds to the longitudinal extension direction of said container 20.

The collar 22 and the base 28 are spaced apart along said axis X by a length L1. For its part, the reservoir 30 has a height L2 following the same axis X. The length L1 is dependent on the height L2 and is such that $0.2 \leq L2/L1 \leq 0.9$. For example, when L1 is substantially equal to 70 mm, L2 may be substantially equal to 60 mm, or to 40 mm, or even to 30 mm.

On the other hand, as shown in FIG. 4, the reservoir 30 has an open axial end 32 and a closed second end 38. More specifically, said reservoir 30 is provided so as to be open on the side of said collar 22 and closed on the side of said base 28.

It should be noted that the reservoir 30 is advantageously capable of abutting said collar 22 and/or said base 28, in particular under the effect of said applicator 40.

It should also be noted that the embodiment shown here shows a straight cylindrical container 20. However, although it is not shown, said container 20 may be of a different shape, for example having a square, rectangular, elliptical or polygonal base. The shape of the external section of said container 20 may vary along the axis X, for example to form a container 20 which is in the shape of an amphora, is in a flared shape, or even a container 20 which is in the shape of a human or animal; the associated advantage is commercial, or essentially aesthetic.

In all cases, the reservoir 30 has a shape which is complementary to the internal section of said container 20, allowing it to slide within said container. In the embodiment shown here, the shape of the reservoir 30 is cylindrical with a circular cross section because the container 20 is cylindrical with a circular cross section.

On the other hand, play is advantageously provided between the two elements—the reservoir 30 and the container 20 in order to ensure that one slides within the other. This play J is such that $0.1 \leq J \leq 0.8$, in millimetres. Said play J is measured in a direction that is substantially perpendicular to the longitudinal extension direction, denoted X in FIGS. 2 to 5. Preferably, said play J is such that $0.3 \leq J \leq 0.5$, in millimetres. In fact, tests have been carried out which show that said sliding is optimal when the play J is within this range of values. In other words, it is provided that the external dimensions of the reservoir 30 are less than the internal dimensions of the container 20, in particular having a difference which is substantially equal to the play J which has just been defined.

It should be noted that this play J also has the advantage of overcoming possible defects, in particular on the internal walls of said container 20, for example when said container is obtained by blow moulding. Likewise, this play J allows for variations in slope of the internal walls of the container 20 (draft angles) when said container is obtained by moulding, in particular injection moulding.

As can be seen from FIG. 2, the collar 22 of the container 20 is equipped with a neck 24 to which the applicator sub-assembly 40 is capable of being attached. On the other hand, the receptacle 10 according to the invention comprises a wiper 50 configured to scrape excess cosmetic product from the applicator 46 when said applicator 46 is removed from said receptacle 10. Said wiper 50 is preferably attached to the inside of the neck 24 of the container 10. In the example shown here, it is provided that the wiper 50 penetrates the reservoir 30 with its open axial end 32.

The reservoir 30 is advantageously filled with viscous cosmetic product, said product preferably being mascara.

It is also interesting to note that the internal diameter of the reservoir 30, in particular in the region of the opening 32, is advantageously substantially equal to the internal diameter of the wiper 50 in the upper part of the neck 24. This prevent any product from flowing back outside of the reservoir 30 between said reservoir 30 and the internal wall of the container 20, in particular when the applicator sub-assembly 40 is reinserted inside the container 20 (see the description of FIG. 4 below).

Advantageously, the internal diameter of the reservoir is constant along the longitudinal extension direction thereof, in other words along the axis X.

As a reminder, FIG. 1 shows a known applicator assembly. In this type of applicator, the cosmetic product moves up towards the top of the container 20' when the applicator is removed from the container 20'. This causes product to accumulate under the collar 22' of said container 20', more specifically under the shoulder formed by said collar 22'. As explained in the introduction, the accumulated cosmetic product P under the collar 20' thus cannot be used by the user, who ends up throwing away the applicator assembly when it is still half full because they think it is empty, since the applicator is no longer loaded with product.

The invention overcomes this drawback at least in part, as explained below.

FIGS. 2 and 3 show a step of using the applicator assembly according to the invention, that is to say the moment at which the user unscrews the applicator sub-assembly 40 from the receptacle 10 and begins to remove it (FIG. 2). This action causes the movement of the reservoir 30, which moves with the applicator 46. As set out in the introduction, the viscosity of the product contained in the reservoir 30 thus becomes an advantage, since it is by means of said viscosity that the reservoir 30 is carried along at the same time as the applicator 46.

Although the applicator 46 is wiped by the wiper 50 in a conventional manner, it is notable that the excess of product is returned to the inside of the reservoir 30 and no longer accumulates (and becomes compacted) under the collar 22' as in the case of a conventional container 20' (see FIG. 1).

For its part, FIG. 3 shows the fact that the present invention does not involve any change to the gesture conventionally used to apply mascara to the eyelashes. In fact, once removed from the receptacle 10, the applicator sub-assembly 40 is in the form of a conventional applicator sub-assembly.

After use, as shown in FIG. 4, returning the applicator sub-assembly 40 to the receptacle 10 pushes the reservoir 30 back into the lowered position.

As shown in FIG. 5, once the reservoir 30 abuts the base of the container, the applicator 46 is once again inside the reservoir 30, in which it is reloaded with product.

Moreover, it is interesting to note that the applicator 46 may abut the base 38 of the reservoir 30. Said applicator 46 therefore provides the possibility of scraping substantially all the product contained in the reservoir 30.

Advantageously, the invention also relates to a method for manufacturing a receptacle 10 such as that described above, which comprises a step of shaping a preform of the container 20, said preform being open at at least one of its axial ends. Preferably, said preform is obtained by material injection moulding. It may also be obtained by blow moulding a plastics impression.

The method according to the invention also comprises a step of shaping the reservoir 30, carried out simultaneously or prior to the step of shaping said preform of the container 10. Preferably, the reservoir 30 is obtained by moulding.

The method according to the invention also comprises a step of positioning the reservoir 30 within said preform. This positioning step consists in inserting the reservoir 30 inside the container 20, whether through an opening provided in the region of what becomes the collar 22 and/or through an opening provided in the region of what becomes the base 28 of said container 20. From this step onwards, it is possible for said reservoir to be filled with product.

Said method comprises a subsequent step of assembling the collar 22 on a first of said axial ends of said preform or assembling the base 28 on the axial end opposite said preform.

It should be noted that this assembly step is, for example, a step of bonding, ultrasonic welding or overmoulding.

This step may also be a screwing step, for example of screwing a removable base 28, in order for the reservoir 30 to be recovered once empty. The advantage associated with this variant (not shown) is found in that the applicator assembly can potentially be reloaded with a new reservoir 30, which is filled with cosmetic product. In fact, it is thus sufficient to unscrew said base 28 which is provided so as to be removable, to remove the empty reservoir 30, to replace it with a filled reservoir 30 and then to screw the base 28 back on. Thus, it is no longer necessary to throw away the container 20 and the applicator sub-assembly 40 each time the cosmetic product is considered to have run out.

Another advantage associated with the invention is found in that the applicator 46 is protected against impacts. In fact, the reservoir 30 in which the applicator 46 is immersed serves as a protective outer layer, in particular during transport of the applicator assembly, which is a product which is usually transported around a fair amount.

It should also be noted that variants are of course possible. In particular, in an additional embodiment, the receptacle of the invention is provided with a seal, for example a scraping seal, arranged between the reservoir and the container, provided so as not to cause friction that is greater than that allowing the reservoir to slide.

In yet another additional embodiment, the wiper may have a shape that is capable of covering the internal walls of the collar, and, therefore, the reservoir is capable of abutting said wiper.

The invention claimed is:

1. Receptacle for a cosmetic product, said receptacle comprising a body forming a container and an intermediate part forming a reservoir, which is capable of containing the cosmetic product and of sliding within said container so as to move with an applicator of said product, under the effect of the viscosity of said product, when said applicator is removed from said reservoir and/or when said applicator is inserted into said reservoir.

2. Receptacle according to claim 1, wherein said container comprises a collar and a base, said reservoir being capable of abutting said collar and/or said base.

3. Receptacle according to claim 2, comprising a wiper configured to scrape excess cosmetic product from the applicator when said applicator is removed, said wiper being capable of penetrating said reservoir when said reservoir is abutting said collar.

4. Receptacle according to claim 2, wherein the container has a longitudinal extension direction (X) along which the collar and the base are situated, said collar and said base being spaced apart along said longitudinal extension direction (X) by a length L1, and said reservoir having a height L2 in the said same direction, such that $0.2 \leq L2/L1 \leq 0.9$.

5. Receptacle according to claim 2, wherein said reservoir is open on the side of said collar and closed on the side of said base.

6. Receptacle according to claim 1, having play J between the container and the reservoir, such that $0.1 \leq J \leq 0.8$, in millimeters.

7. Method for manufacturing a receptacle for a cosmetic product, said receptacle comprising a body forming a container and an intermediate part forming a reservoir, which is capable of containing the cosmetic product and of sliding within said container so as to move with an applicator of said product, under the effect of the viscosity of said product, when said applicator is removed from said reservoir and/or when said applicator is inserted into said reservoir, said method comprising a step of shaping a preform of the container, said preform being open at at least one of its axial ends.

8. Manufacturing method according to claim 7, comprising a step of shaping the reservoir, carried out simultaneously or prior to the step of shaping said preform.

9. Manufacturing method according to claim 8, comprising a step of positioning the reservoir within said preform.

10. Manufacturing method according to claim 9, comprising a step of assembling a collar on a first of said axial ends of said preform and/or assembling a base on the axial end opposite said preform, said assembly step following the step of positioning said reservoir within said preform.

11. Cosmetic product applicator assembly, comprising:

a receptacle according to claim 1, and an applicator sub-assembly capable of being attached to said receptacle so that at least part of said applicator sub-assembly is housed within said reservoir.

12. Applicator assembly according to claim 11, wherein said reservoir is filled with viscous cosmetic product.

13. Applicator assembly according to claim 12, wherein said product is mascara.

14. Receptacle according to claim 1 wherein the receptacle is a bottle.

15. Cosmetic product applicator assembly, comprising:

a receptacle obtained using the method according to claim 7, and an applicator sub-assembly capable of being attached to said receptacle so that at least part of said applicator sub-assembly is housed within said reservoir.

16. Applicator assembly according to claim 15, wherein said reservoir is filled with viscous cosmetic product.

17. Applicator assembly according to claim 16, wherein said product is mascara.

* * * * *